US011196189B2

(12) United States Patent
Struckmeier et al.

(10) Patent No.: US 11,196,189 B2
(45) Date of Patent: Dec. 7, 2021

(54) CONNECTION DEVICE AND METHOD FOR AN ELECTRONIC HOUSING FOR CONNECTING A CONDUCTOR, PARTICULARLY A SHIELD CONDUCTOR

(71) Applicant: Phoenix Contact GmbH & Co. KG, Blomberg (DE)

(72) Inventors: Armin Struckmeier, Paderborn (DE); Eugen Penner, Stadtoldendorf (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 0 days.

(21) Appl. No.: 16/763,561

(22) PCT Filed: Nov. 15, 2018

(86) PCT No.: PCT/EP2018/081458
§ 371 (c)(1),
(2) Date: May 13, 2020

(87) PCT Pub. No.: WO2019/096945
PCT Pub. Date: May 23, 2019

(65) Prior Publication Data

US 2020/0366005 A1 Nov. 19, 2020

(30) Foreign Application Priority Data

Nov. 16, 2017 (BE) ..... 2017/5841

(51) Int. Cl.
*H01R 4/48* (2006.01)
*H01R 4/50* (2006.01)
(Continued)

(52) U.S. Cl.
CPC ..... *H01R 4/4818* (2013.01); *H01R 4/5066* (2013.01); *H01R 13/447* (2013.01);
(Continued)

(58) Field of Classification Search
CPC ..... H01R 12/88; H01R 12/714; H01R 13/24; H01R 13/2442; H01R 13/62933;
(Continued)

(56) References Cited

U.S. PATENT DOCUMENTS 5,098,317 A 3/1992 Lau
7,540,760 B1 * 6/2009 Chen ..... H01R 4/2433 439/409
(Continued)

FOREIGN PATENT DOCUMENTS

DE 19613557 A1 * 6/1997 ..... H01R 4/4818
DE 19613557 A1 6/1997
(Continued)

*Primary Examiner* — Abdullah A Riyami
*Assistant Examiner* — Justin M Kratt
(74) *Attorney, Agent, or Firm* — Leydig, Voit & Mayer, Ltd.

(57) ABSTRACT

An electronics housing includes: a housing body; and a printed circuit board. The housing body has a connecting device for connecting a conductor, in particular a shield conductor, of a cable to the printed circuit board. The connecting device has a receiving body in which a receiving space with an opening for the conductor is formed. A cover for the opening is provided and is movable between an open position, in which the cover opens the opening for inserting an uninsulated conductor section of the conductor into the receiving space, and a closed position, in which the cover closes the opening at least in sections. The receiving body of the connecting device is disposed such that the printed circuit board is arrangeable with at least one contact section in the receiving space, and, in a closed position, the cover presses the uninsulated conductor section.

19 Claims, 15 Drawing Sheets

(51) Int. Cl.

| | |
|---|---|
| ***H01R 13/447*** | (2006.01) |
| ***H01R 13/66*** | (2006.01) |
| *H01R 13/50* | (2006.01) |
| *H01R 13/453* | (2006.01) |
| *H01R 13/52* | (2006.01) |
| *H01R 13/62* | (2006.01) |
| *H01R 12/73* | (2011.01) |
| *H01R 12/88* | (2011.01) |
| *H01R 13/436* | (2006.01) |
| *H01R 13/627* | (2006.01) |
| *H01R 12/71* | (2011.01) |
| *H01R 13/629* | (2006.01) |
| *H01R 9/05* | (2006.01) |
| *H01R 13/58* | (2006.01) |
| *H01R 13/24* | (2006.01) |
| *H01R 13/639* | (2006.01) |

(52) U.S. Cl.
CPC ..... *H01R 13/6658* (2013.01); *H01R 4/4809* (2013.01); *H01R 9/0527* (2013.01); *H01R 12/714* (2013.01); *H01R 12/73* (2013.01); *H01R 12/88* (2013.01); *H01R 13/24* (2013.01); *H01R 13/2442* (2013.01); *H01R 13/436* (2013.01); *H01R 13/4538* (2013.01); *H01R 13/501* (2013.01); *H01R 13/5213* (2013.01); *H01R 13/5837* (2013.01); *H01R 13/62* (2013.01); *H01R 13/629* (2013.01); *H01R 13/6271* (2013.01); *H01R 13/62933* (2013.01); *H01R 13/639* (2013.01)

(58) Field of Classification Search
CPC .. H01R 13/639; H01R 13/501; H01R 13/629; H01R 13/62; H01R 12/73; H01R 13/436; H01R 13/4538; H01R 13/5213; H01R 13/6271; H01R 4/4818; H01R 4/5066; H01R 13/447; H01R 13/6658; H01R 9/0527; H01R 13/5837; H01R 4/4809
USPC ..... 439/73, 331
See application file for complete search history.

(56) References Cited

U.S. PATENT DOCUMENTS

| | | | | |
|---|---|---|---|---|
| 2011/0318975 | A1 | 12/2011 | Stefan et al. | |
| 2019/0123493 | A1* | 4/2019 | Rights | H01R 12/53 |

FOREIGN PATENT DOCUMENTS

| | | | |
|---|---|---|---|
| DE | 10152520 | A1 | 5/2003 |
| DE | 202008016856 | U1 | 5/2010 |
| WO | WO 2010066399 | A1 | 6/2010 |

* cited by examiner

CONNECTION DEVICE AND METHOD FOR AN ELECTRONIC HOUSING FOR CONNECTING A CONDUCTOR, PARTICULARLY A SHIELD CONDUCTOR

CROSS-REFERENCE TO PRIOR APPLICATIONS

This application is a U.S. National Phase application under 35 U.S.C. § 371 of International Application No. PCT/EP2018/081458, filed on Nov. 15, 2018, and claims benefit to Belgian Patent Application No. BE 2017/5841, filed on Nov. 16, 2017. The International Application was published in German on May 23, 2019 as WO 2019/096945 under PCT Article 21(2).

FIELD

The invention relates to an electronics housing which has a connecting device for connecting a conductor, in particular a shield conductor, of a cable to a printed circuit board of the electronics housing. The aforementioned connecting devices of the type in question are used for electrically connecting an uninsulated conductor section of the conductor, in order to electrically connect the latter to an electrical component, in particular a printed circuit board, which is received in the electronics housing at least in sections.

BACKGROUND

Connecting devices for electronics housings of the type in question are known, for example, from DE 20 2008 016 856 U1 and provide that the connecting devices has a receiving body which has a receiving space for the conductor, wherein an opening is provided for inserting the uninsulated conductor section of the conductor into the receiving space.

In this case, providing contacting means for electrically contacting an uninsulated conductor section of the electrical conductor arranged in the receiving space, which contacting means can be designed in different ways, is known.

The contacting means can thus comprise a clamping screw which contacts the uninsulated conductor section of the conductor in a clamping manner and thereby holds it in the receiving space of the connecting device.

It is furthermore known therefrom that the connecting device has a cover which can be moved between an open position, in which the cover opens the opening for inserting the uninsulated conductor section into the receiving space, and a closed position, in which it closes the opening at least in sections. The cover is in this case fixed to the receiving body by means of screws, in order to secure it against undesired opening.

SUMMARY

In an embodiment, the present invention provides an electronics housing, comprising: a housing body; and a printed circuit board, wherein the housing body has a connecting device for connecting a conductor, comprising a shield conductor, of a cable to the printed circuit board, wherein the connecting device has a receiving body in which a receiving space with an opening for the conductor is formed, wherein a cover for the opening is provided and is movable between an open position, in which the cover opens the opening for inserting an uninsulated conductor section of the conductor into the receiving space, and a closed position, in which the cover closes the opening at least in sections, and wherein the receiving body of the connecting device is configured such that the printed circuit board is arrangeable with at least one contact section in the receiving space, and, in a closed position, the cover presses the uninsulated conductor section inserted into the receiving space for the electrical contacting thereof against the contact section of the printed circuit board arranged in the receiving space.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
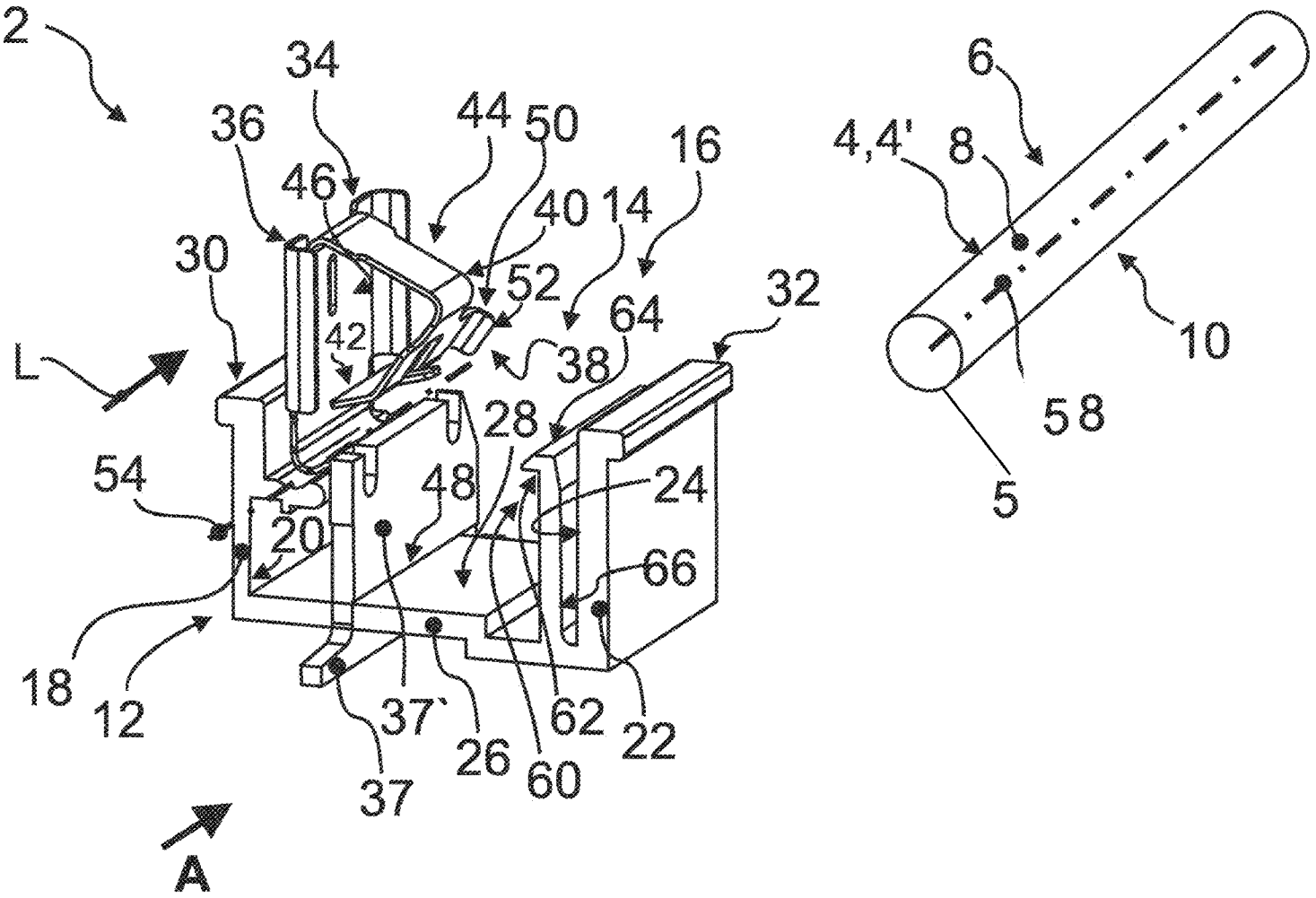
FIG. 1 a schematic illustration of an exemplary embodiment of an electronics housing according to the invention, wherein the illustration is focused on a connecting device formed according to the invention on the electronics housing in a perspective view, wherein the cover is in an open position, FIG. 2 the exemplary embodiment of the electronics housing according to the invention with regard to the connecting device of FIG. 1 in the same illustration as in FIG. 1, but in a side view indicated by A in FIG. 1, wherein the cover is in an open position, FIG. 3 the exemplary embodiment the exemplary embodiment of the electronics housing according to the invention with regard to the connecting device in the same illustration and view as in FIG. 2, wherein the cover is in a further open position, FIG. 4 the exemplary embodiment the exemplary embodiment of the electronics housing according to the invention with regard to the connecting device in the same illustration and view as in FIG. 2, wherein the cover is in a closed position, FIG. 5 the exemplary embodiment of an electronics housing according to the invention with regard to the cover of the connecting device in the same illustration and view as in FIG. 1, FIG. 6 the cover of the connecting device formed according to the invention in the same illustration as in FIG. 5, but in a further perspective view rotated in relation to FIG. 5, FIG. 7 the cover of the connecting device formed according to the invention in the same illustration as in FIG. 5, but in a view indicated by A in FIG. 1, wherein the arrangement of an uninsulated conductor section on the cover is illustrated when the cover is in a closed position, FIG. 8 the cover of the connecting device formed according to the invention in the same illustration as in FIG. 5, but in a further side view indicated by A in FIG. 1, FIG. 9 the cover of the connecting device formed according to the invention in the same illustration as in FIG. 5, but in a further perspective view, wherein the cover is in a closed position, FIG. 10 the cover of the connecting device formed according to the invention in the same illustration as in FIG. 9, but in a further side view indicated by C in FIG. 9, FIG. 11 the cover of the connecting device formed according to the invention in the same illustration as in FIG. 7, but in a view indicated by D in FIG. 7, FIG. 12 the exemplary embodiment of an electronics housing according to the invention in a schematic illustration and in a side view indicated by A in FIG. 1, wherein the cover is in an open position, FIG. 13 the exemplary embodiment of an electronics housing according to the invention in the same illustration as in FIG. 12, but in a perspective view directed toward the housing head, wherein the cover is in an open position, FIG. 14 the exemplary embodiment of an electronics housing according to the invention in the same illustration as in FIG. 13, wherein the cover is in a closed position, FIG. 15 the exemplary embodiment of an electronics housing according to the invention in the same illustration as in FIG. 12, but in a view indicated by E in FIG. 12, wherein the cover is in an open position.

In an embodiment, the present invention provides an electronics housing which can be used to connect different conductor cross-sections or cable cross-sections to a printed circuit board of the electronics housing and makes possible the secure connection of a cable to the printed circuit board or the secure electrical contacting between the printed circuit board and the cable as well as simple handling.

In an embodiment, the present invention moves away from the idea of making changes to the design of a cable or of providing the use of adapters, in order to ensure a corresponding connection of the respective conductor/shield conductor of a cable to the printed circuit board.

Rather, the invention is based on the basic idea of designing an electronics housing with an electrical connecting device in such a way that the secure contacting of the conductor/shield conductor is ensured and adaptation to different conductor cross-sections also takes place automatically by the connecting device, so that manual adaptation steps are not required.

The invention achieves the object posed in that the receiving body of the connecting device is configured and designed in such a way that the printed circuit board can be or is arranged with at least one contact section in the receiving space, in order to realize electrical contacting between the contact section of the printed circuit board and the cable or its uninsulated conductor section.

For this purpose, the invention also provides for the cover, in a closed position, to press, in particular by applying a spring force, the uninsulated conductor section inserted into the receiving space against the contact section of the printed circuit board arranged in the receiving space, in order to electrically contact the uninsulated conductor section.

For an electrical connection between the uninsulated conductor section of the cable and the printed circuit board, the contact section of the printed circuit board can be designed to be electrically conductive at least in sections and at least on one side.

Moreover, the contact section can preferably have at least one contact element for this purpose. This contact element can be arranged on a side facing or facing away from the uninsulated conductor section inserted into the receiving space, so that direct contacting between cable and contact section or indirect contacting, preferably by means of the cover, is made possible according to the invention. The contact element can be formed on the contacting section in the simplest way by a flat contact element.

The invention makes it possible in a simple manner for the cover to be movable from an open position into a closed position by actuating the cover. In the closed position, the conductor is securely held, on the one hand, on the receiving body by means of the cover and electrical contacting between the uninsulated conductor section and the contact section is also produced.

Accordingly, further, contacting means (in particular, special or dedicated contacting means) for electrical contacting of the cable or its uninsulated conductor section are in principle dispensable as a result of the invention. Electrical contacting between the cable and the printed circuit board or its contact section provided for this purpose can therefore preferably take place directly between the cable and the printed circuit board/contact section.

Against this background, the invention advantageously achieves a reduction of the elements necessary for the connection, as a result of which production and cost advantages are also achieved.

At the same time, the invention makes it possible in a simple manner that, by actuating the cover, the cover can be moved into a closed position, in which the conductor is securely held, on the one hand, on the receiving body by means of the cover and electrical contacting with the conductor is also produced.

The invention thus also has the advantage that a connecting device according to the invention can be realized in a simple design as well as inexpensively.

The invention furthermore achieves the advantage of ensuring a simple connection option of a cable to a printed circuit board and of also reducing the contact resistances between the printed circuit board and the uninsulated conductor cross-section.

The invention also achieves a vibration-resistant connection between the uninsulated conductor section and the printed circuit board. In addition, different conductor cross-sections can be connected to the electronics housing or its printed circuit board in a simple manner.

Within the scope of the invention, an electronics housing with a housing body serves to house electrical/electronic components.

For this purpose, an electronics housing according to the invention provides a housing body for housing electrical/electronic components, which may in particular be one or a plurality of further populated and unpopulated printed circuit board(s) in addition to the one printed circuit board. Accordingly, an electronics housing according to the invention can comprise one as well as a plurality of printed circuit boards and electrical/electronic components.

Within the scope of the invention, an electronics housing in particular also includes an electronics housing with electrical/electronic components housed therein, which are accordingly received in the housing body at least in sections.

A combination and arrangement of the electrical/electronic components in the electronics housing therefore forms, according to the invention, in particular an electronic device, which is thus encompassed by the invention.

Within the scope of the invention, a printed circuit board is preferably a carrier, in particular a plate-like carrier, and consists at least of sections of an electrically insulating material with conductive connections, the so-called conductor tracks, arranged thereon or adhering thereto. Such a printed circuit board serves in particular for the mechanical fastening or electrical connection of electrical/electronic components or parts by means of the aforementioned conductor tracks.

Furthermore, within the scope of the invention, the uninsulated conductor section of the conductor is also shortened and referred to as a conductor section.

According to the invention, the term "uninsulated" means that the conductor or a conductor section of the conductor for electrical contacting is freed from insulation at least in sections.

Within the scope of the invention, a conductor is to be understood as an electrical conductor which serves for the transmission of electrical currents or signals. Contacting is to be understood within the scope of the invention in particular as electrical contacting, in order to thereby enable an electrical connection.

According to the invention, the terms "conductor" or "shield conductor" denote an electrical conductor/shield conductor which conducts electrical currents or signals. The statements relating to a conductor therefore likewise apply to the particular design of the conductor as a shield conductor. Thus, within the meaning of the invention, the term "conductor" also includes a shield conductor.

According to the invention, the conductor is a component part of a cable which, in addition to at least one conductor or shield conductor, may also comprise, as a multi-core cable, further conductors which electrically conduct further currents or signals. In addition, within the scope of the invention, a cable in particular has an electrically insulating sheathing of the conductor(s).

In this case, it is considered according to the invention that the sheathing may comprise one or more sheath layers which surround the at least one conductor or shield conductor. The sheathing is also referred to hereinafter as electrical insulation or in short as insulation.

Within the scope of the invention, the conductor (or the shield conductor) preferably serves as a protective conductor or for potential compensation of devices, contacts, lines, electrical/electronic components electrically connected thereto.

Several conductors of the cable can accordingly also serve this purpose. Within the scope of the invention, a conductor may therefore be formed by a wire/strand (or core), a plurality of conducting wires (or strands/cores) as well as a shield braid consisting of a plurality of strands/wires/cores. The shield braid can be formed in various ways, for example and in particular by a braided or twisted strand.

An advantageous development of the invention provides that the receiving body has a through-opening, in particular a slit-shaped through-opening, for the printed circuit board, by means of which the printed circuit board can be or is arranged with at least one contact section projecting into the receiving space [for the connection of the cable thereto (to the printed circuit board)].

The invention thus provides the advantage that a connection for a cable can be provided in a simple manner in that the through-opening formed on the receiving body is designed in such a way that at least one contact section of the printed circuit board can be inserted at least partially through the through-opening into the receiving space and can be arranged there.

This achieves the direct contacting of the printed circuit board by inserting the cable and the printed circuit board into the receiving space of the connecting device.

An electronics housing according to the invention can thus be used for various printed circuit boards. This type of connection for a printed circuit board can also be realized very cost-effectively.

According to the invention, the printed circuit board can also be formed by a wall of the receiving body, so that the printed circuit board, in particular its contact section, is formed at least in sections by a section of the wall of the housing body. This in particular also encompasses according to the invention that the wall of the receiving housing component part is used for housing electrical or electronic components and preferably forms an outside of the electronics housing.

For this purpose, an advantageous development of the invention provides that a wall of the receiving body is formed at least in sections by a section of the printed circuit board, in particular the contact section of the printed circuit board.

The invention thus makes it possible to use a component part of the electronics housing as a printed circuit board or to integrally receive the printed circuit board in sections into a housing wall of the housing body, so that it is embedded, for example and in particular, in such a housing wall.

Following this idea, a further advantageous development provides that the printed circuit board is an integral component part of the housing body, in particular of a housing wall of the housing body.

This preferably encompasses according to the invention that a section of a housing wall forms a printed circuit board and, for this purpose, is, preferably integrally, arranged or formed in the housing wall.

A further advantageous development of the invention is characterized in that at least one spring element is arranged on the cover for the opening of the connecting device and is configured and designed in such a way that it projects at least in sections into the receiving space when the cover is in the closed position and in this case presses, by applying a spring force, at least the uninsulated conductor section arranged in the receiving space toward the receiving space, in order to electrically contact the uninsulated conductor section, whereby the conductor or its uninsulated conductor section is held in a clamping manner between the cover and the receiving space and is furthermore pressed by loading with the spring force against the printed circuit board or its contact section.

When the cover is in the closed position, the spring element is brought for this purpose into abutment at least in sections on the uninsulated conductor section of the cable, which is inserted into the receiving space for electrical contacting.

When the cover is in the closed position, the spring element therefore exerts a spring force on the uninsulated conductor section of the cable and thus presses the uninsulated conductor section toward the receiving space or toward an inner wall of the receiving space and presses the uninsulated conductor section against the contact section of the printed circuit board. A high vibration resistance of the contacting is thus achieved.

Once the cover is in a closed position, the opening of the receiving space is closed such that the uninsulated conductor section or conductor arranged therein is held in the receiving space and in particular cannot be removed from the receiving space via this opening. The cover therefore likewise serves to securely hold the conductor in the receiving space, as a result of which the secure contacting of the conductor also takes place.

The invention leads, for example and in particular, to the advantage that the electrical contacting of the conductor or shield conductor via its uninsulated conductor section can take place through the cover.

Accordingly, the invention comprises a cover on which a spring element is arranged, which is configured and designed in such a way that, in the closed position, it applies a spring force at least to the uninsulated conductor section inserted into the receiving space, thereby making it possible to contact different conductor cross-sections with a connecting device according to the invention without requiring manual adaptation to the relevant conductor cross-section. Such an adaptation is unnecessary, since a connecting device according to the invention automatically adapts to the cross-section of a conductor by means of the spring element and securely electrically contacts the conductor.

In addition, the invention thus makes it possible for the component parts for forming a connecting device according to the invention to be captively held on the receiving body, as a result of which their handling is also simplified.

In an electronics housing according to the invention, the cover used can be moved in various ways from an open position, in which it opens the receiving space for inserting the conductor or its uninsulated conductor section, and a closed position, in which the cover at least in sections covers the opening via which the receiving space is accessible and thus closed accordingly.

It is thus possible within the scope of the invention for the cover to be guided in a translationally movable manner to the receiving body or electronics housing and in particular along a translationally guide so that it can be moved, for example, in particular more linearly to the receiving body or electronics housing.

It is thus possible according to the invention to translationally guide the cover in its movement, for example by means of a linear guide. Furthermore, within the scope of the invention, it is also possible to design the cover as a single element in such a way that it can be applied or plugged onto the opening in a simple manner. For this purpose, the cover can be movable freely as well as in a guided manner.

For a simple realization of a cover with a movement guide, a further advantageous development of the invention provides for the cover to be arranged or mounted on the receiving body so as to pivot about a pivot axis between the open position and the closed position.

In addition to the advantage of a simple realization, this also results in the advantage that the movement guide can be designed in a simple manner. Furthermore, there is the advantage that the cover can be held captively on the receiving body. Moreover, a pivotable arrangement/mounting of the cover on the receiving body enables the simple actuation/handling of the cover to pivot it, as a result of which the contacting of an uninsulated conductor section arranged in the receiving space is also facilitated.

According to the invention, the cover can advantageously be arranged on the receiving body in such a way that the conductor can be inserted into the receiving space along its conductor axis. In this respect, the uninsulated conductor section need not be a free end of the conductor or cable. Thus, there are no particular demands on the position of the uninsulated conductor section on the cable.

In order to simplify the insertion of the uninsulated conductor section into the receiving space, a further advantageous development provides that the pivot axis is arranged on the receiving body in such a way that it is arranged in parallel to the conductor section of the conductor received in the receiving space for the contacting thereof. The pivot axis is therefore aligned or arranged in particular in parallel to the conductor axis of the conductor section along which the conductor section is longitudinally extended between the ends of the conductor.

Within the scope of the invention, the conductor axis is therefore an axis along which conductor is longitudinally extended between its free ends.

According to the invention, the spring element can be designed in various ways. For example, it is possible within the scope of the invention to provide a coil spring which is arranged on the cover and, when the cover is in a closed position, applies a spring force to the uninsulated conductor section, which is inserted into the receiving space for the electrical contacting thereof, in order to load it accordingly.

Moreover, it is possible according to the invention to design a spring element in the manner of a leaf spring.

A further advantageous development of the invention provides for the spring element to have at least one spring leg, in particular a strip-shaped spring leg, which is inclined in relation to the cover and which, when the cover is in a closed position, is brought into abutment at least in sections on the uninsulated conductor section of the conductor arranged in the receiving space.

The spring leg is preferably strip-shaped and designed in the manner of a leaf spring, for example by means of an elastically deformable strip, and is therefore resiliently deflectable toward the receiving space or in the opposite direction.

This makes it possible to hold or fix the conductor in the receiving space in a simple manner via the uninsulated conductor section. The conductor can thereby be held correspondingly securely. A secure electrical contacting of the conductor is thus likewise achieved.

The invention has the advantage that a spring leg can be produced in a simple manner. The invention furthermore achieves the advantage that the spring element allows the automatic adaptation to the relevant conductor cross-section or the cross-section of the uninsulated conductor section simply and cost-effectively. Thus, the simple handling of a connecting device according to the invention is also brought about.

A further advantageous development of the invention takes into account that an inclination of the spring leg in relation to the cover can be directed toward or away from the pivot axis. An associated incline with which the spring leg is arranged in relation to the cover is thus accordingly negative in a direction toward the pivot axis or positive. It is thus possible to arrange the conductor section of the conductor in the receiving space in a simple manner by means of the spring leg, as takes place automatically according to the invention during a movement of the cover from the open position into the closed position.

A further advantageous development of the invention provides that the spring leg is held, in particular integrally formed, with at least one end on the cover.

It is thus possible to realize the spring leg in a simple manner, as a result of which production and cost advantages can be achieved. The cover with the spring leg arranged thereon can thus be produced as an integral component, for example by means of a stamped and bent part.

Moreover, it is possible to design the spectrum of conductors contactable with the connecting device to be broad.

For example, the invention provides for the spring leg to be designed in the manner of a spring clip, which projects into the receiving space with an arc section, for example and in particular, when the cover is in the closed position. In this case, the bottom section enables a resilient or elastic deformation of the spring clip, in particular by shaping.

Furthermore, it is possible, for example and in particular, to design the spring leg in such a way that it has a free end which can be deflected resiliently or elastically in relation to the further free end, as is provided in a further advantageous development of the invention.

According to the invention, this encompasses that the spring leg is arranged on the cover in particular in such a way that the free end of the spring leg faces or faces away from the pivot axis of the cover.

The invention makes it possible in a simple manner to achieve a spring effect of the spring leg. Moreover, this results in the advantage that the spring leg can be formed in various ways and can likewise also have an inelastic material or be formed from such a material. In this case, the spring effect would at least to a predominant extent be due to the design, as a result of which the material elasticity takes a back seat to a shaping-related elasticity of the cover or of the spring leg and its arrangement on the cover.

It is furthermore possible to adapt the connecting device of an electronics housing according to the invention to various fields of application, so that it can also be corrosion-resistant or adapted to an aggressive environment, for example.

A further advantageous development of the invention provides that the spring leg is arranged on a rear side of the cover, which faces the receiving space when the cover is in the closed state. This makes it possible for the connecting device of an electronics housing according to the invention to require little space and to thus also be usable in other applications which only provide little space for connecting a conductor.

In order to be able to use the available space optimally, the spring leg is preferably extended between the edges which delimit the cover or its rear side. It is in this case provided within the scope of the invention that the spring leg is longitudinally extended along the rear side of the cover at least in sections.

Within the scope of the invention, the term "longitudinally extended" is to be understood as a geometric extent in a direction which results in particular between the ends, in particular free ends, of the relevant element/component part.

In order to be able to deflect the spring leg as far as possible, a further advantageous development provides that the spring element is connected by a connecting section, in particular at a distance, to the cover, in particular formed thereon, preferably integrally. It is thus possible to be able to connect a broad spectrum of conductors/shield conductors of different cross-sections, without requiring further adaptation of a connecting device according to the invention or parts having to be replaced or supplemented.

The connecting section is, for example and in particular, designed to be arch-shaped, so that it is thus possible to extend or arrange the spring section in a simple manner along the aforementioned rear side of the cover.

Accordingly, the spring section can be bent away from the cover by means of the connecting section. It is likewise possible to achieve a resilient arrangement of the spring section on the cover via the connecting section, so that, in addition to a large deflection of the spring section, a good spring effect can likewise be achieved. In this respect, the invention provides, for example and in particular, that the spring section and the connecting section cooperate to achieve a spring effect.

According to the invention, it is likewise possible for the cover or the spring element to be electrically conductive at least in sections and in particular to be configured and designed in such a way that it electrically contacts the contact section of the printed circuit board on a side facing away from the uninsulated conductor section inserted into the receiving space.

It can thus be achieved that the connection of the printed circuit board also or exclusively takes place by means of the cover or spring element. The contacting of at least one side of the contact section or of the printed circuit board is thus also indirectly possible via the spring element or the cover.

In this respect, the invention also makes it possible to electrically contact by means of the spring element a side of the printed circuit board facing away from the uninsulated conductor section inserted into the receiving space. In this respect, the contacting of the aforementioned facing-away side of the contact section of the printed circuit board with the uninsulated conductor section of the cable would take place indirectly via the cover or its spring element.

In order to increase the reliability with which a conductor or an uninsulated conductor section which is arranged in the receiving space is contacted or held, a further advantageous development of the invention provides that the spring element has at least one projection projecting from the spring leg toward the receiving space when the cover is in the closed position. As a result, the projection results in an elevation which is turned from the spring leg toward the receiving space and by means of which contact is made possible even with small conductor cross-sections. The application bandwidth of a connecting device according to the invention for different conductor cross-sections is thus enlarged.

Irrespective of the electrical contacting, the secure pressing or holding of the conductor in the receiving space, thus the holding effect, is increased by the projection. The projection can furthermore prevent movement within the receiving space along the conductor axis.

Such a projection can be realized, for example, by a stud or knob as well as a dome or ripple or a corresponding elevation, which are formed from the spring leg by deformation.

For simple realization, it is possible to form the at least one projection of the spring element by means of a contact tongue which, when the cover is in the closed position, extends at an angle away from the spring leg toward the receiving space.

The contact tongue serves to form a defined contact with the conductor or its uninsulated conductor section, wherein the contact tongue extends transversely, in particular orthogonally, on the rear side of the spring leg, which faces the receiving space when the cover is in the closed position. The contact tongue thus extends from the rear side of the spring leg at an angle in the direction of the surface normal.

The contact tongue preferably contacts the uninsulated conductor section of the conductor with one of its free ends. This results in at least line-shaped or punctiform contacting of the conductor, which enables secure contacting in particular in the case of small cross-sections of a conductor and, as a result, secure connecting for conducting electrical currents or signals.

For this purpose, it has been found to be particularly advantageous that, for good contacting or secure holding of the uninsulated conductor section or covering of a broad spectrum of different conductor cross-sections, the contact tongue extends away from the spring leg at an obtuse angle, in particular at an angle between 70° and 90°. During tensile loading of the uninsulated conductor section (along the conductor axis), this results in the contact tongue being erected, which counteracts the loosening or a movement out of the receiving space in the pulling direction of the cable.

In order to reduce the necessary number of individual parts for producing a connecting device of an electronics housing according to the invention, a further advantageous development of the invention provides that the contact tongue is formed on the spring leg and is thus integrally connected thereto.

It is thus likewise possible to, according to the invention, keep the production expenditure for a connecting device low and to also achieve the secure holding of the contact tongue on the spring leg.

The conductor can be contacted in various ways by the connecting device of an electronics housing according to the invention. It is thus possible, for example, for the uninsulated conductor section to be pressed directly against the contact section of the printed circuit board by means of the cover. Additionally or exclusively, it is also possible to contact the uninsulated conductor section by means of the spring leg or the projection arranged thereon/the contact tongue arranged thereon.

For this purpose, a further advantageous development of the invention first of all provides that at least the spring element, in particular the cover, consists at least of sections of an electrically conductive material or comprises such an electrically conductive material and can be used for electrically contacting the uninsulated conductor section arranged in the receiving space.

This results in a further possibility of simplifying the production of the connecting device and of producing it cost-effectively. It is also possible to adapt the spring element correspondingly to a very good conductivity and to use correspondingly high-quality conductive materials for this purpose.

Moreover, it is possible by means of such a spring element to design the cover in such a way that further component parts for electrical contacting of the conductor can be dispensed with.

In order to further simplify the production of a connecting device according to the invention, a further advantageous development of the invention provides that the cover is integrally formed with the spring element arranged thereon, in particular by a stamped and bent part, in particular from a metal sheet. Against this background, it is possible to design the cover in such a way that it can fulfill multiple functions in its design as an integral body, in that the cover also serves to close the opening and to contact the conductor. The cover is thus designed as an integral component in which the spring element is included with its function. The cover and the spring element arranged thereon are therefore preferably formed from the same material.

For the secure contacting of the conductor, a further advantageous development of the invention provides a latching devices which latches in such a way when the cover is in the closed position that it blocks a movement of the cover, in particular from the closed position into the open position. There are a plethora of possibilities for realizing a latching device. For example, elevations can interact with recesses formed on the cover or the receiving body.

It is also possible to provide latching hooks which engage in a recess or engage behind a shoulder at least in sections and latch with each other when the cover is in the closed position. For this purpose, the plethora of possibilities is very large, so that the aforementioned embodiment only represents a non-conclusive section of the possible embodiments according to the invention.

In this respect, a further advantageous development of the invention provides that the receiving space is arranged, in particular formed, on an electronics housing according to the invention. The walls which delimit the receiving space are thus formed at least in sections on an electronics housing according to the invention or its housing body or in particular are integrally formed thereon.

In order to facilitate the attachment of the cable or conductor to a connecting device according to the invention, a further advantageous development of the invention provides that the receiving space is arranged on an outside of the electronics housing according to the invention.

The receiving space of the connecting device of an electronics housing according to the invention is thus freely accessible for inserting an uninsulated conductor section, whereby its handling is correspondingly simplified.

An electronics housing according to the invention serves, for example and in particular, for populating a switchgear cabinet and is configured and designed for this purpose, preferably for mounting on a support rail, as described below.

In order to simplify the mounting of an electronics housing according to the invention, a further advantageous development of the invention provides for the housing body to be configured and designed for mounting on a support rail. The scope of the invention thus encompasses that the housing body is preferably configured and designed for latching onto a support rail.

For latching onto a support rail, an electronics housing according to the invention has a latching device which is arranged on the housing body and engages, for example and in particular, behind the edges of the support rail for this purpose. The design of such a latching device can be realized, for example, by means of hook bodies which are resiliently adjustable in relation to one another and are arranged on the housing body and engage behind the support rail edge in a latching manner when latching onto the support rail. Detaching is brought about, for example, by bending one of the hooks away from the support rail, whereupon the housing body can be detached from the support rail.

The features described above and below also apply comprehensively so that they can be exchanged/transferred between the component parts of the invention in isolation from one another or separately from a specifically described constellation or from a dependence on other elements, component parts, features or other requirements.

The invention is explained in more detail below with reference to the attached drawing, in which an exemplary embodiment of an electronics housing according to the invention is shown as a representative of a plurality of arrangement and design possibilities.

All of the described features and features illustrated in the drawing form the subject-matter of the invention individually and in any combination with each other, independently of their grouping and their references, and also independently of their description or illustration in the drawing. The features are therefore not bound to the configuration explained below, but can also characterize an electronics housing according to the invention when isolated from each other as well as in a deviating combination.

The figures in the drawing show an exemplary embodiment of an electronics housing according to the invention in a schematic illustration in each case. The illustrations in the figures are therefore in particular not necessarily to scale, so that the scales selected in each case in the figures may also differ from each other.

For greater clarity, the illustrations are reduced to the elements/components/component parts supporting an understanding, wherein the same or corresponding components/component parts or elements are provided with the same reference signs in the figures. For a better overview, all elements/components/component parts are not always provided with reference signs in the figures, wherein the assignment results from the same illustration or an illustration adapted to the view.

In the case of the same or a similar structure, the description is reduced below to the differences between the figures for a better overview.

The features illustrated on the basis of the figures also apply correspondingly or analogously comprehensively as well as in a manner isolated from each other to further electronics housings formed according to the invention. The invention is therefore not limited to the exemplary embodiments or combinations and dependencies described and shown.

FIG. 1 shows an exemplary embodiment of a connecting device 2 of an electronics housing according to the invention (this is more extensive in FIG. 12, among others, and provided with reference sign 74) in a perspective view in a schematic illustration.

A connecting device 2 of an electronics housing according to the invention is also referred to in short below as a connecting device 2.

Figure 12:
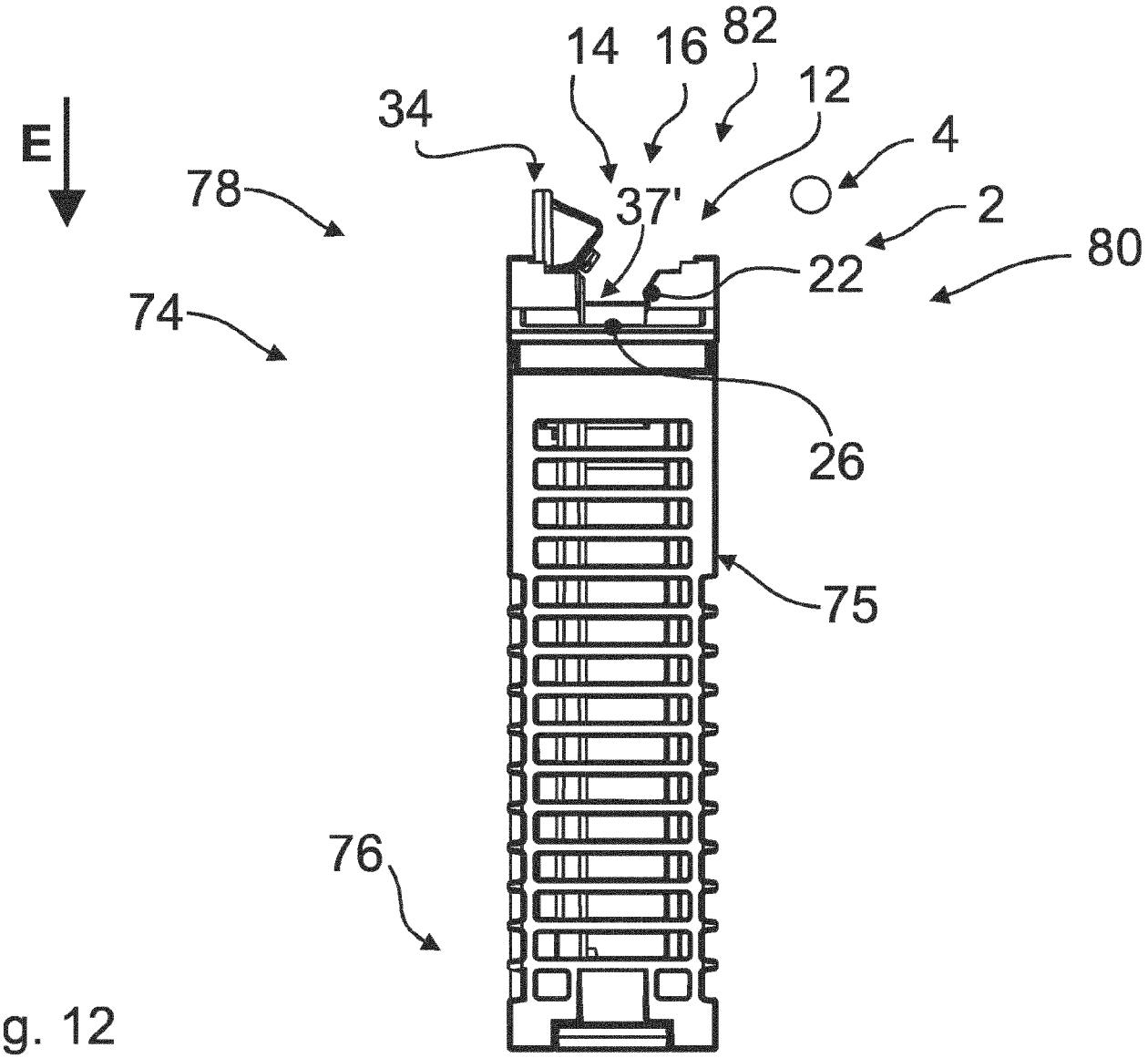

The following description refers initially to a possible design and operation of the connecting device, according to which the connecting device is explained based on the further component parts of the exemplary embodiment of an electronics housing 74 according to the invention (cf. FIG. 12 and others).

The connecting device 2 is configured and designed to connect a conductor 4 of a cable 6, wherein the conductor 4 in the exemplary embodiment shown is a shield conductor 4' of the cable 6, which forms a sheath layer 8 of the cable 6, which surrounds further conductors of the cable 6. For this purpose, the shield conductor 4' is designed as a shield braid consisting of individual strands.

The cable 6 with its further conductors and the shield conductor 4' surrounding them are represented schematically in the figures by an uninsulated conductor section 10, so that the individual conductors are not shown as individual elements in the figures.

The shield braid is moreover not shown in detail, but is illustrated representatively by the lateral surface of the uninsulated conductor section 10 shown.

The conductors, including the aforementioned shield conductor 4', are sheathed with an insulating layer which is formed from an insulating material, but is not present at least on the uninsulated conductor section 10 for electrically contacting the shield conductor 4'.

The connecting device 2 is equipped with a receiving body 12, on which a receiving space 14 with an opening 16 for the conductor 4 is formed, which is explained in more detail below.

The receiving body 12 is formed by a first leg 18 for forming a first side inner wall 20 and a second leg 22 opposite the first leg 18 for forming a second side inner wall 24 between which the receiving space 14 is formed. The legs 18, 20 are arranged in parallel to one another and are connected to one another via a web 26, which forms the bottom 28 of the receiving space 14.

Due to the arrangement of the side inner walls 20, 24 and the web 26, the receiving body 12 has a U-shaped cross-section, as a result of which the receiving space 14 is of groove-shaped design.

The opening 16 for inserting and removing the conductor 4 or its uninsulated conductor section 10 into/from the receiving space 14, which opening is located opposite the bottom 28 of the receiving space 14, is located between the free ends 30, 32 of the legs 18. The connecting device 2 also has a cover 34 for the opening 16 of the receiving space 14, which cover is movable between an open position for inserting an uninsulated conductor section 10 of the conductor 4 into the receiving space 14 and a closed position for at least in sections covering the opening 16, in which closed position the opening 16 of the receiving space is covered at least in sections and is thus closed for inserting or removing the conductor section.

Once the cover 34 is in a closed position, the opening 16 of the receiving space 14 is closed such that the uninsulated conductor section 10 or conductor 4 arranged therein cannot be removed from the receiving space 14 via the opening 16. The cover 34 therefore likewise serves to securely hold the conductor 4 by means of its uninsulated conductor section 10 in the receiving space 14, as a result of which the secure contacting of the conductor 4 is likewise achieved.

For this purpose, a spring element 36 is arranged on the cover 34 and is configured and designed such that it projects into the receiving space 14 when the cover 34 is in the closed position and thereby presses the uninsulated conductor section 10 of the conductor 4 arranged in the receiving space 14 toward the receiving space 14 by applying a spring force.

Figure 4:
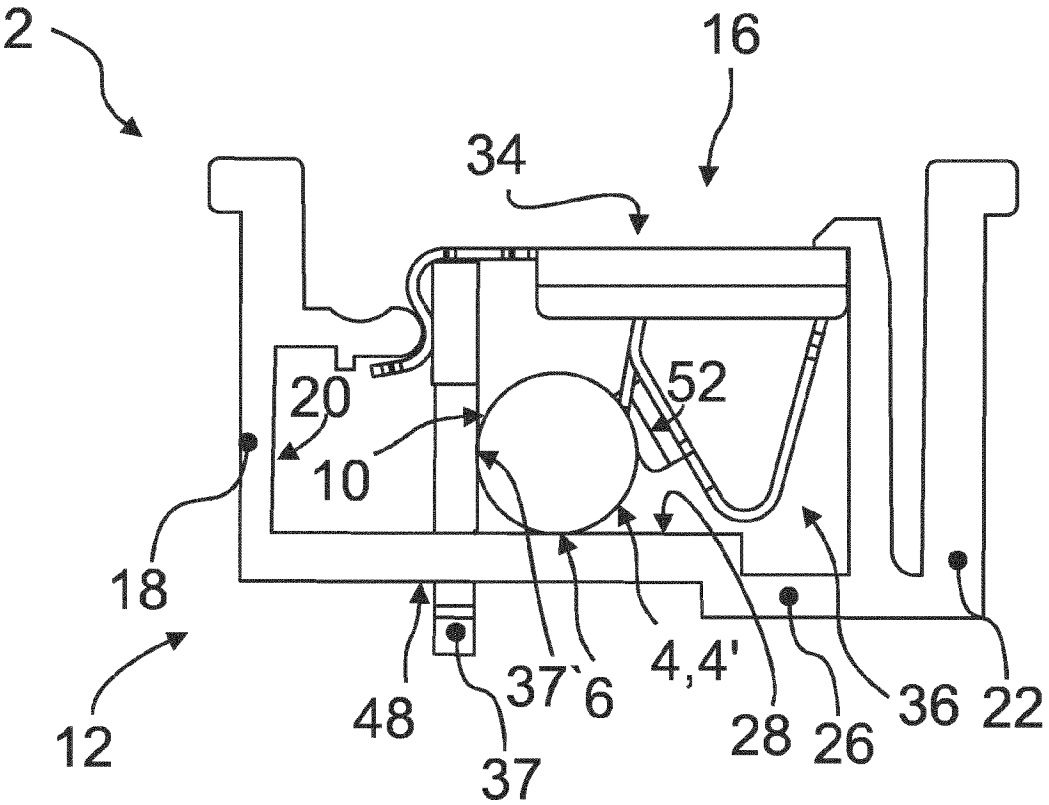

In the process, the spring element 36 presses the conductor 4 against a printed circuit board 37 projecting in sections into the receiving space and brings the uninsulated conductor section 10 of the conductor 4 into abutment on the printed circuit board 37 or its contact section 37', as shown in FIG. 4.

According to the invention, at least one of the aforementioned legs 18, 22 or one of the side inner walls 20, 24 can be formed by a printed circuit board 37. It is also possible for at least one of the legs 18, 22 or one of the side inner walls 20, 24 to be formed by a housing wall which, in turn, can be configured and designed according to the invention at least in sections as a printed circuit board 37 with corresponding conductor tracks.

The spring element 36 furthermore has a spring leg 38 which is arranged on the cover 34 in such a way that the spring leg 38 is inclined in relation to the cover 34 and is brought into abutment at least in sections on the uninsulated conductor section 10 of the conductor 4 arranged in the receiving space 14 when the cover 34 is in the closed position.

The spring leg 38 is held with its one end 40 on the cover 34 and is formed thereon for this purpose in this exemplary embodiment. The spring leg 38 furthermore has a free end 42, which is resiliently deflectable in relation to the aforementioned end 40, with which it is held or formed on the cover 34. In this exemplary embodiment, the free end 42 faces the pivot axis 54 of the cover 34, while the end 40 faces away from the pivot axis 54.

The spring element 36 is held on the cover 34 via a connecting section 44 in that the end 40 of the spring leg 38 is connected to the cover 34 via the connecting section 44 and is formed via it on the cover 34. In this case, the spring leg 38 is held with its one end 40 at a distance from the cover 34.

In addition, the spring leg 38 is arranged on a rear side 46 of the cover 34 which, in the closed state, faces the receiving space 14.

The spring element 36 and the cover 34 are made of an electrically conductive material. However, this need not necessarily be the case if, for example, electrical conductivity is dispensed with.

The cover 34 is formed integrally with the spring element 36 formed thereon and of a stamped and bent part, in particular of a metal sheet.

In this exemplary embodiment, the cover 34 is also electrically conductive so that the cover 34, in cooperation with the spring element 36 arranged thereon, can serve to electrically contact the uninsulated conductor section 14 of the electrical conductor 4 inserted into the receiving space 14.

In the closed state, the cover 34 also provides an additional electrical connection between the uninsulated conductor section 10 of the conductor 4 and the printed circuit board 37, as is explained again below with reference to the further figures.

In order to receive the conductor section of the printed circuit board 37 in the receiving space of the connecting device 2, the receiving body 12 of the connecting device 2 is configured and designed such that the printed circuit board 37 with at least one contact section 37' can be or is (as shown here) arranged in the receiving space 14 for connecting the cable 6 thereto.

For this purpose, the receiving body 12 has a slit-shaped through-opening 48 for the printed circuit board 37, through which the printed circuit board 37 can be or is (as shown here) arranged with the contact section 37' projecting into the receiving space 14 for the connection of the cable 6 to the printed circuit board 37. This slit-like through-opening 48 is shown schematically in FIG. 2.

Another electrical connection is provided by the pressure of the uninsulated conductor section 10 of the conductor 4 via the spring element 36 on the printed circuit board 37, whereby the printed circuit board 37 and the uninsulated conductor section 10 of the conductor 4 are in direct, spring-loaded, electrical contact with one another. This reduces the number of necessary individual parts for the contacting.

In order to improve the ability to contact or the holding of an uninsulated conductor section 10 inserted into the receiving space 14, it is provided that the spring leg 38 has a projection 50 which is formed by a contact tongue 52 in this exemplary embodiment.

When the cover 34 is in the closed position, the contact tongue 52 is bent away from the spring leg 38 and extends at an obtuse angle, which is 75° in the exemplary embodiment shown, toward the receiving space 14, as illustrated with reference to FIG. 11.

The contact tongue 52 is thus formed on the spring leg 38 and is thus held captively on the cover 34.

Furthermore, the cover 34 is configured and designed in such a way that it is arranged on the receiving body 12 so as to pivot about a pivot axis 54 between the open position and the closed position and is accordingly pivotably mounted the receiving body 12. In this case, the spring leg 38 is arranged on the cover 34 in such a way that the free end 42 faces the pivot axis 54 of the cover 34, as a result of which the spring leg 38 is inclined in a direction toward the pivot axis 54 of the cover 34 and accordingly inclined in relation to the cover 34. The incline of the spring leg 38 toward the pivot axis 54, in which the spring leg 38 is longitudinally extended from its one end 40 toward its free end 42 is thus negative.

Figure 2:
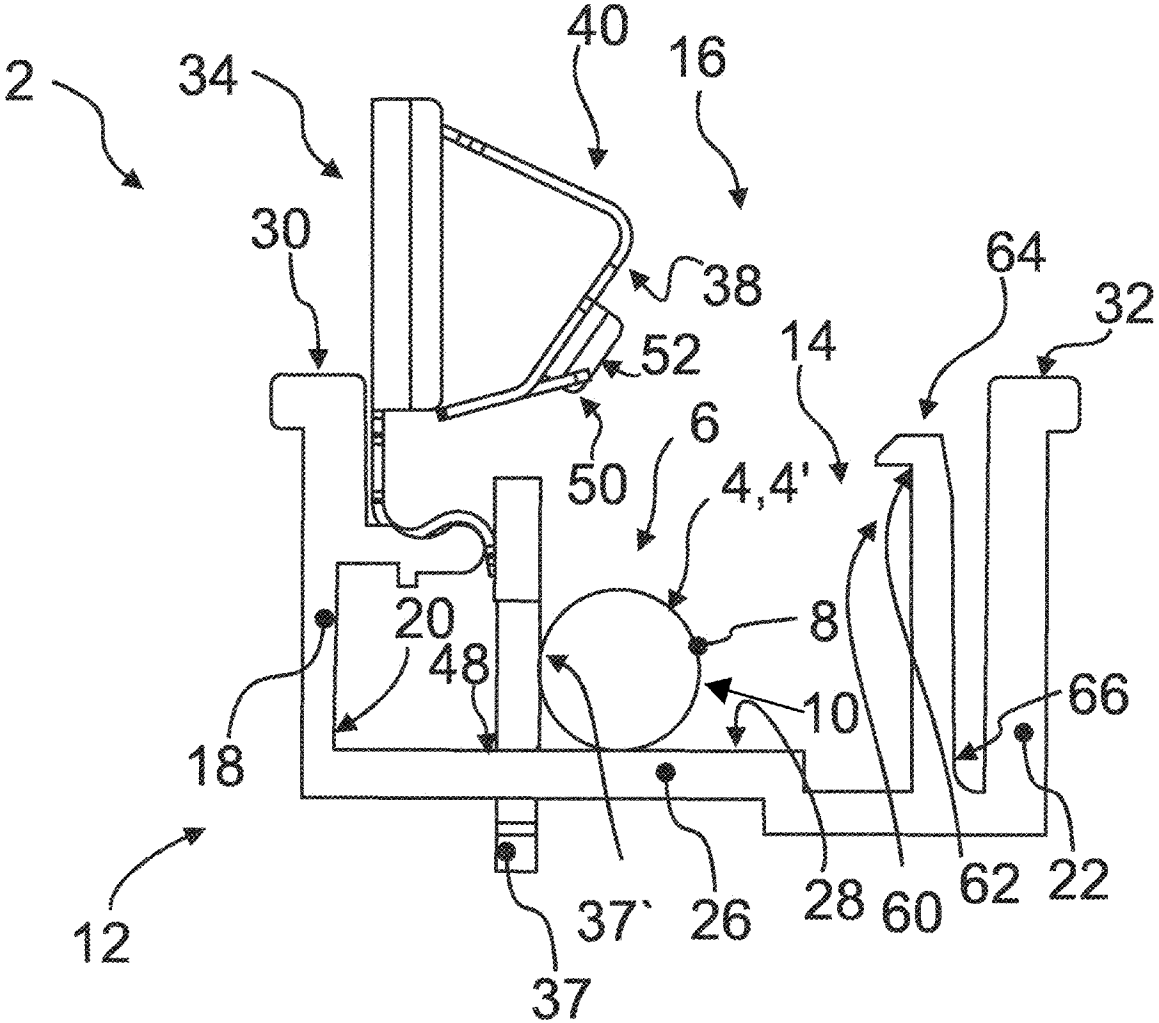

In the exemplary embodiment shown of a connecting device 2 according to the invention, the conductor 4 is arranged in sections for its electrical contacting with its free end 56 in the receiving space 14, as illustrated in FIG. 2. In addition, a further free end of the cable 6 is configured and designed for electrical connection to another terminal.

FIG. 1 shows that the pivot axis 54 extends in parallel to the longitudinal extent L of the receiving space 14 along which the uninsulated conductor section 10 received in the receiving space 14 is longitudinally extended. Accordingly, the pivot axis 54 is also parallel to the uninsulated conductor section 10 of the conductor 4 received in the receiving space 14, which conductor in turn is longitudinally extended along the conductor axis 58.

As can be seen in FIG. 2, the pivot axis 54 and the conductor axis 58 are arranged in the same direction. It can also be seen in FIG. 2 that the connecting device 2 provides a latching device 60 which, in the shown closed position of the cover 34, latches together in such a way so as to block a movement of the cover, so that the cover 34 is held securely in the closed position and an undesired opening of the opening 16 of the receiving space 14 is prevented.

In this exemplary embodiment, the latching devices 60 has for this purpose a latching hook 62 which in turn has a free end 64 which is elastically pivotable in relation to its further end 66 with which the latching hook 60 is formed on the receiving body 12. The latching hook 60 thus enables the cover 34 to be securely held in its closed position.

Due to its design, the latching hook 60 furthermore allows the movement blockage to be canceled without destruction, in order to be able to move the cover 34 from a closed position into an open position.

Figure 3:
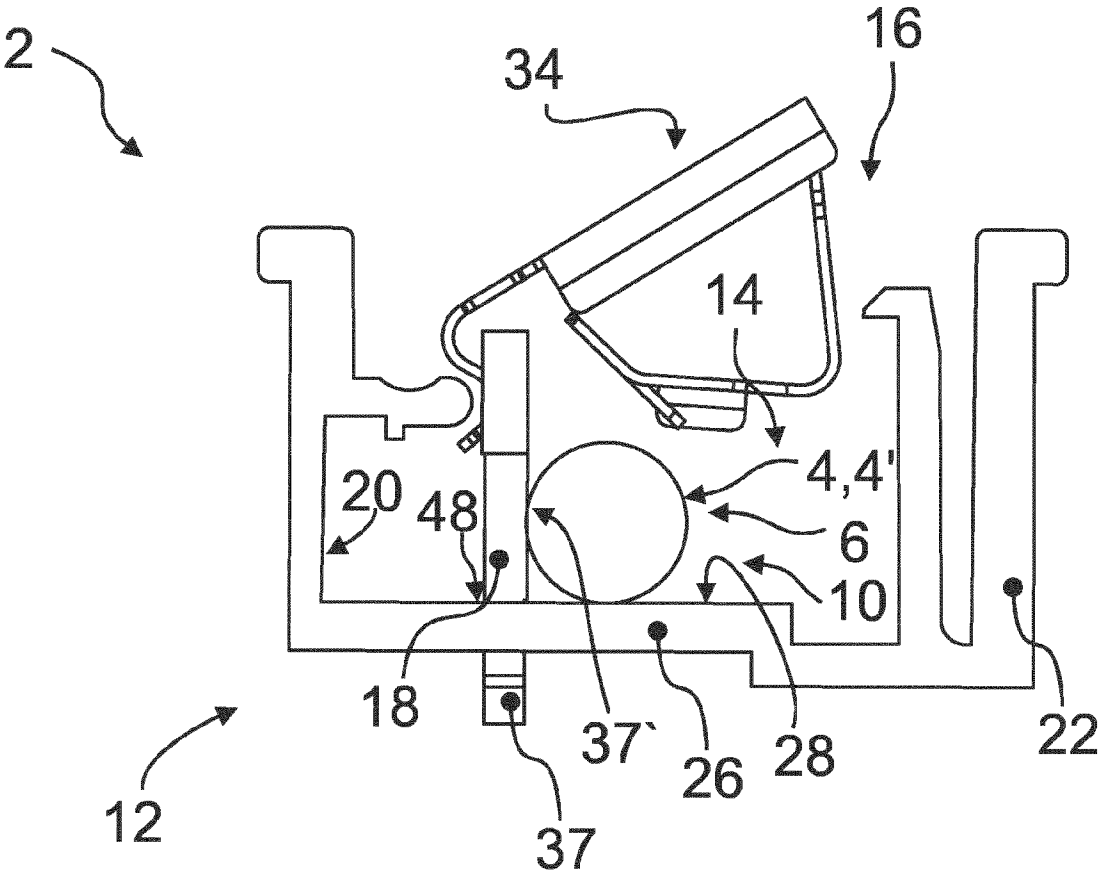

FIG. 3 illustrates a position of the cover 34, which is another open position in which the opening 16 of the receiving space 14 is enabled for inserting the uninsulated conductor section 10 into the receiving space 14.

The cover 34 can be moved from the open position shown in FIG. 3 into a further open position, in which it further opens the opening 16 of the receiving space 14. It is also possible to move the cover 34 from this open position into a closed position, which is illustrated with reference to FIG. 4.

FIG. 4 illustrates a closed position of the cover 34, in which it covers the opening 16 of the receiving space 14, in order to fix the uninsulated conductor section 10 of the conductor 4 in the receiving space 14.

As already described above, the spring element 36 presses the conductor 4 against the printed circuit board 37 projecting in sections into the receiving space 14 and brings the conductor 4 into abutment on the printed circuit board 37 or its contact section 37'. It is thus possible for a contacting to take place by abutting the conductor 4 against at least one contact section 37' of the printed circuit board 37.

In this exemplary embodiment, the contact section has a contact element, which can be designed in various ways and is not shown, for the electrical contacting of the uninsulated conductor section 10 of the cable 6. Such contact element is realized in this exemplary embodiment by means of a conductive plate-shaped element.

Furthermore, in this exemplary embodiment, an electrical connection between the printed circuit board 37 and the conductor 4 is enabled by means of the spring element 36 and the cover 34. In this case, when the cover 36 is in the closed position, the spring element 36 is brought into abutment on the conductor 4 and the cover 34 is brought into abutment on the printed circuit board 37 or a side of the contact section facing away from the conductor 4, so that electrical currents can also be conducted between the printed circuit board 37 and the conductor 4 in this way.

Figure 5:
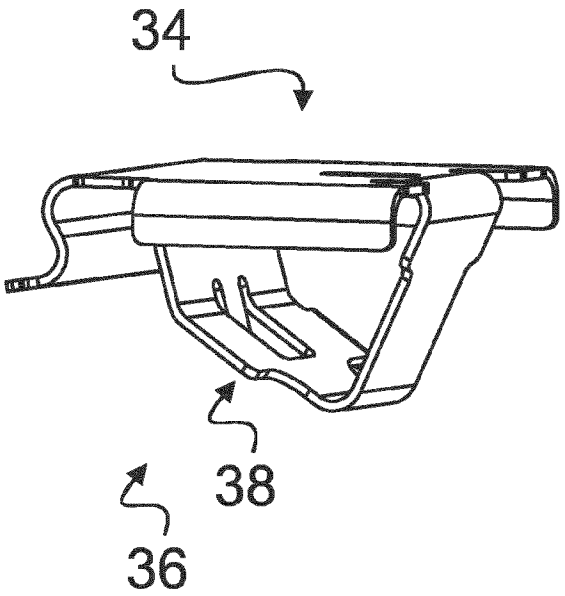

FIG. 5 shows the cover 34 of the connecting device 2 in a perspective view for illustrating its design as well as the arrangement of the spring element 36.

Figure 6:
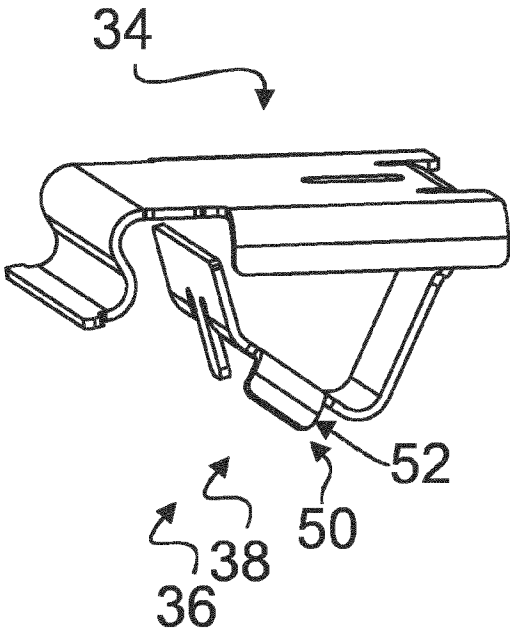

FIG. 6 shows the cover 34 of the connecting device 2 for further illustrating its design in a further perspective view.

Figure 7:
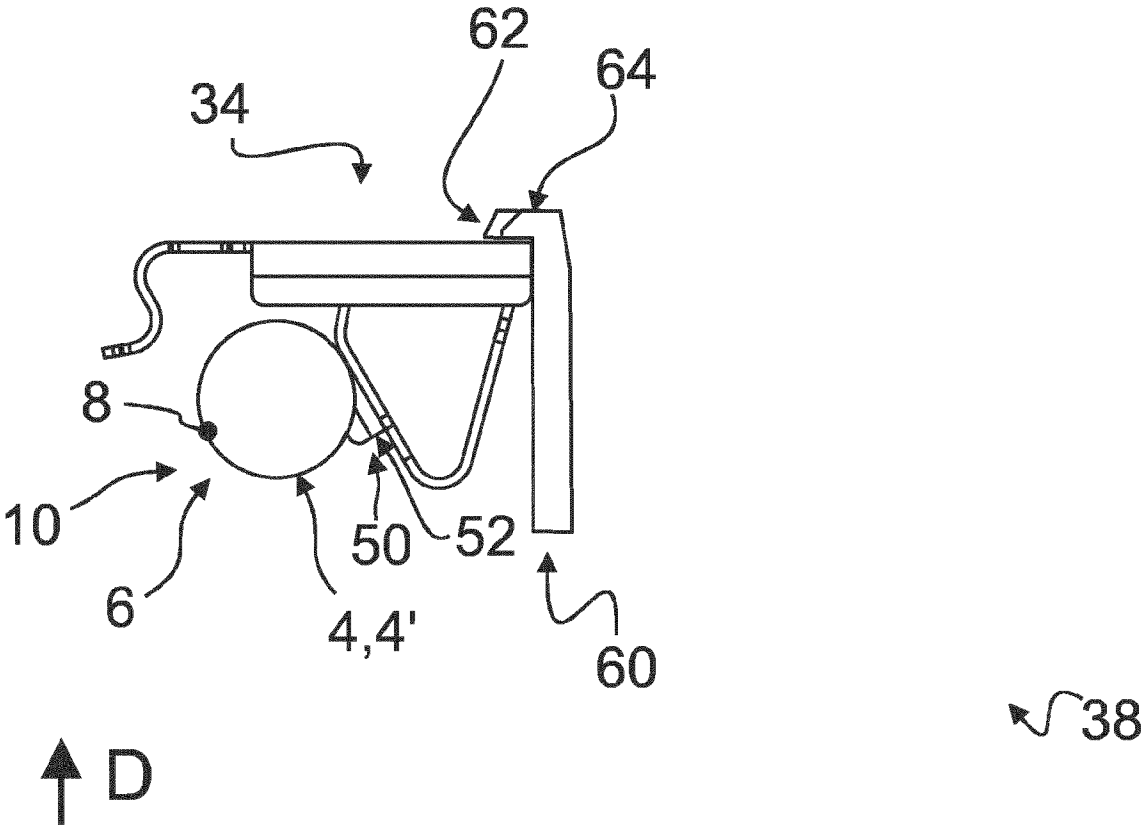

FIG. 7 shows the cover 34 of the connecting device 2 with an arrangement of the conductor 4 or its uninsulated conductor section 10 in the receiving space 14, wherein the cover 34 is in a closed position. The illustration in FIG. 7 is focused on the cover 34 with the conductor 4 arranged thereon.

Figure 8:
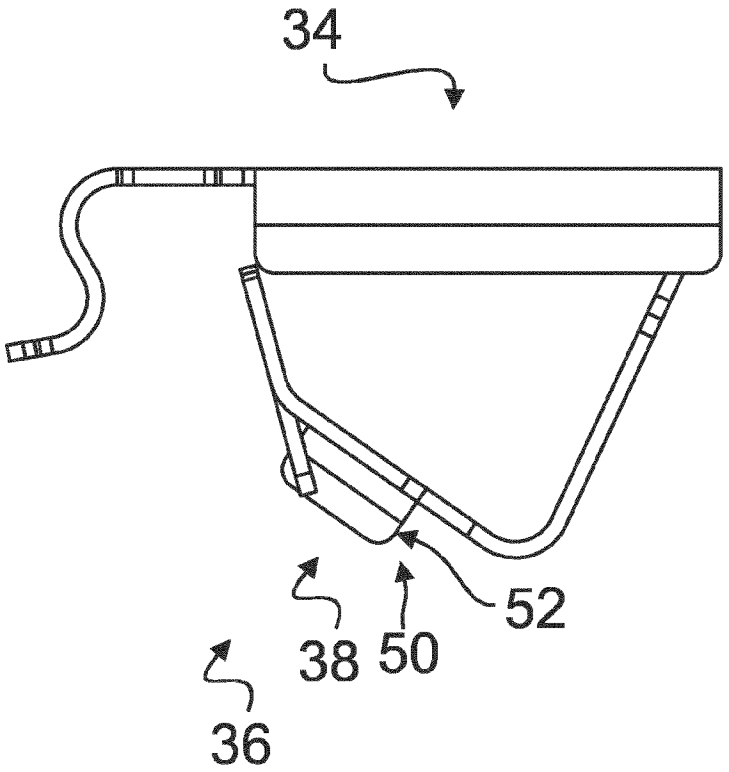

FIG. 8 shows the cover 34 of the connecting device 2 of FIG. 1 in a further view for better visibility of its design.

Figure 9:
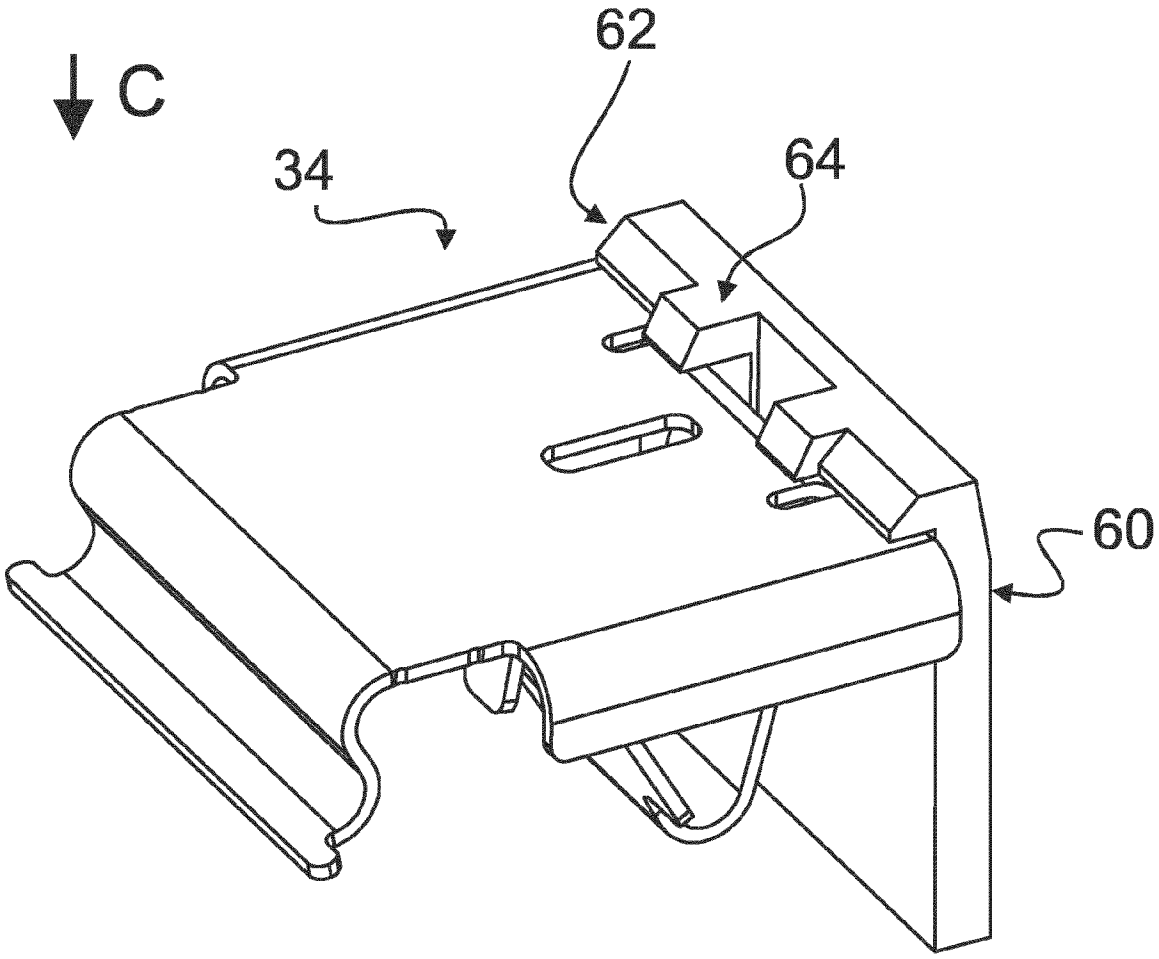

FIG. 9 shows the cover 34 of the connecting device 2 in a further perspective view, wherein the cover 34 is in a closed position and is secured in this closed position by the latching devices 60.

Figure 10:
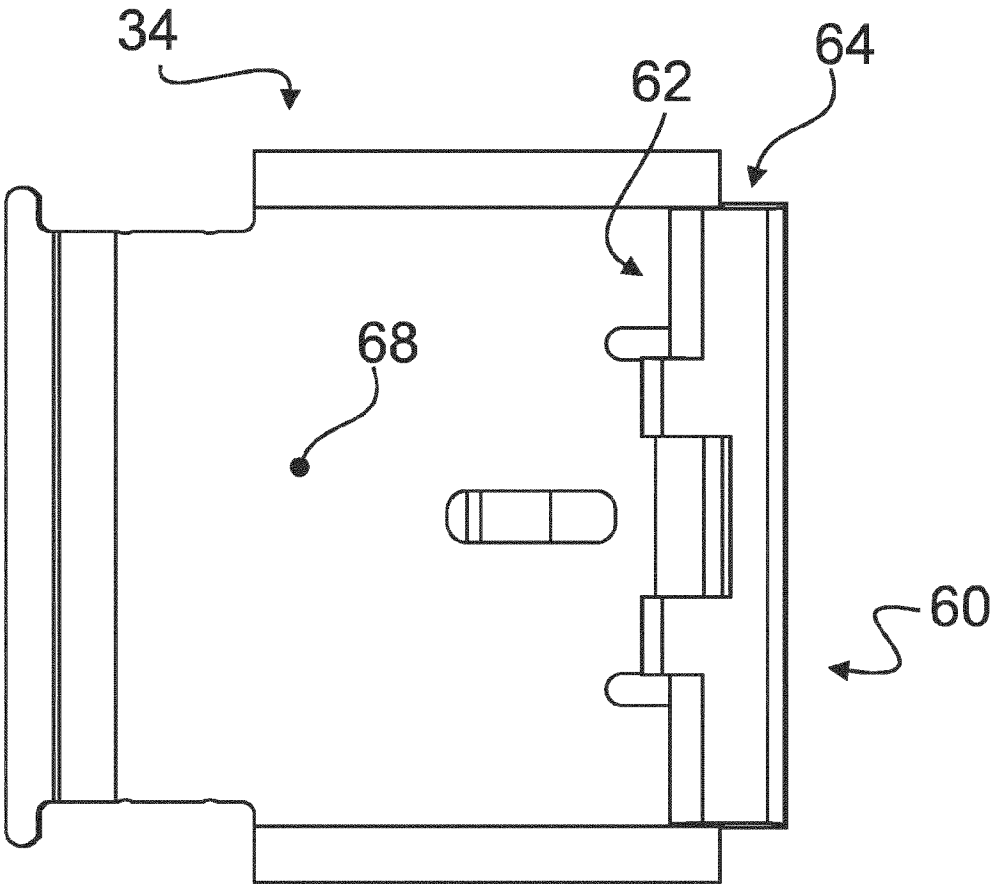

FIG. 10 again shows the cover 34 of FIG. 9 in a closed position in a view indicated by C in FIG. 9 for further illustration of the effect of the latching device 60, wherein the latching hook 62 in sections overlaps the cover 34 at its upper side 68, which faces away from the receiving space 14 when the cover 34 is in the closed position, and thus holds it closed.

Figure 11:
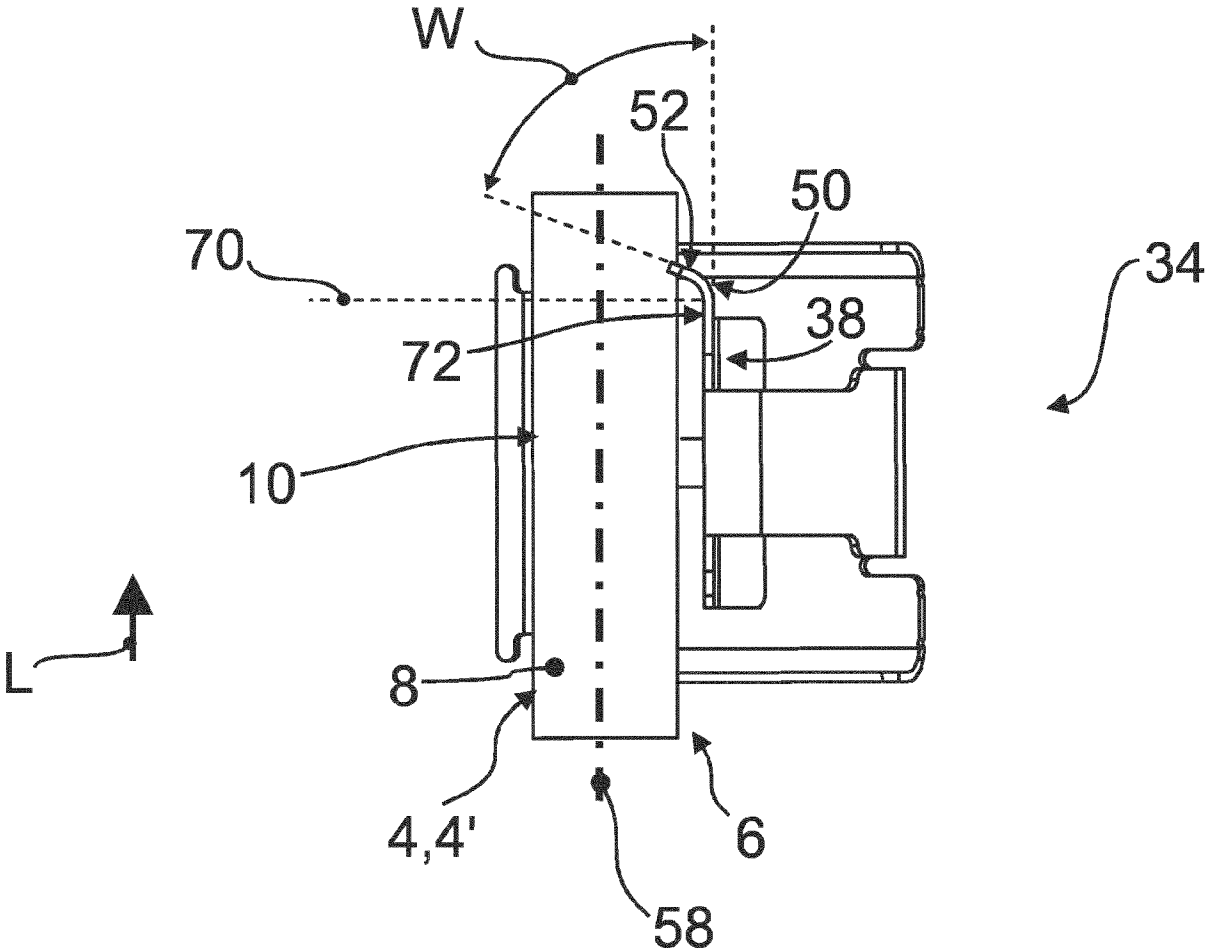

FIG. 11 illustrates the arrangement of the contact tongue 52 on the spring leg 38. As can be seen, the contact tongue 52 is angled, as an embodiment of a projection 50 from the spring leg 38, in the direction of a surface normal 70 from an abutment side 72 of the spring leg 38 with which it faces the conductor 4 and is bent away from the spring leg 38 at an angle W with an angular magnitude of 75°. In the closed position, the contact tongue 52 therefore projects from the spring leg 38 toward the receiving space 14. When the cover 34 is in the closed position, the abutment side 72 of the spring leg 38 faces the receiving space 14 and likewise projects into it.

When the cover 34 is in the closed position, the contact tongue 52 abuts against the uninsulated conductor section 10 of the conductor 4 in order to ensure electrical contacting.

FIG. 12 shows the arrangement of the connecting device 2 on the exemplary embodiment of an electronics housing according to the invention in the same illustration as in FIG. 1, but in a side view indicated by A in FIG. 1 in its arrangement on an electronics housing 74, wherein the cover 34 is in an open position.

The printed circuit board 37 arranged in the housing body 75 of the electronics housing 74 projects in sections with a contact section 37' into the receiving space 14, specifically in such a way that the uninsulated conductor section 10 arranged in the receiving space 14 is electrically connected to the contact section 37' of the printed circuit board 37 when the cover 34 is in the closed position. This type of electrical connection is also shown with reference to FIG. 4 and explained with reference to the further figures.

The housing body 75 of the electronics housing 74 is configured and designed for arrangement on a support rail, wherein, for this purpose, a housing base 76 of the electronics housing 74 in this exemplary embodiment faces the support rail, is configured and designed to arrange the electronics housing 74 on the support rail and hold it there.

The connecting device 2 is arranged on an outside 78 of the electronics housing 74, specifically in this exemplary embodiment on a housing head 80 which, when the electronics housing 74 is arranged on the support rail, faces away therefrom. In this exemplary embodiment, the connecting device 2 is arranged on an outside 82 of the electronics housing 74 or its housing body 75.

Figure 13:
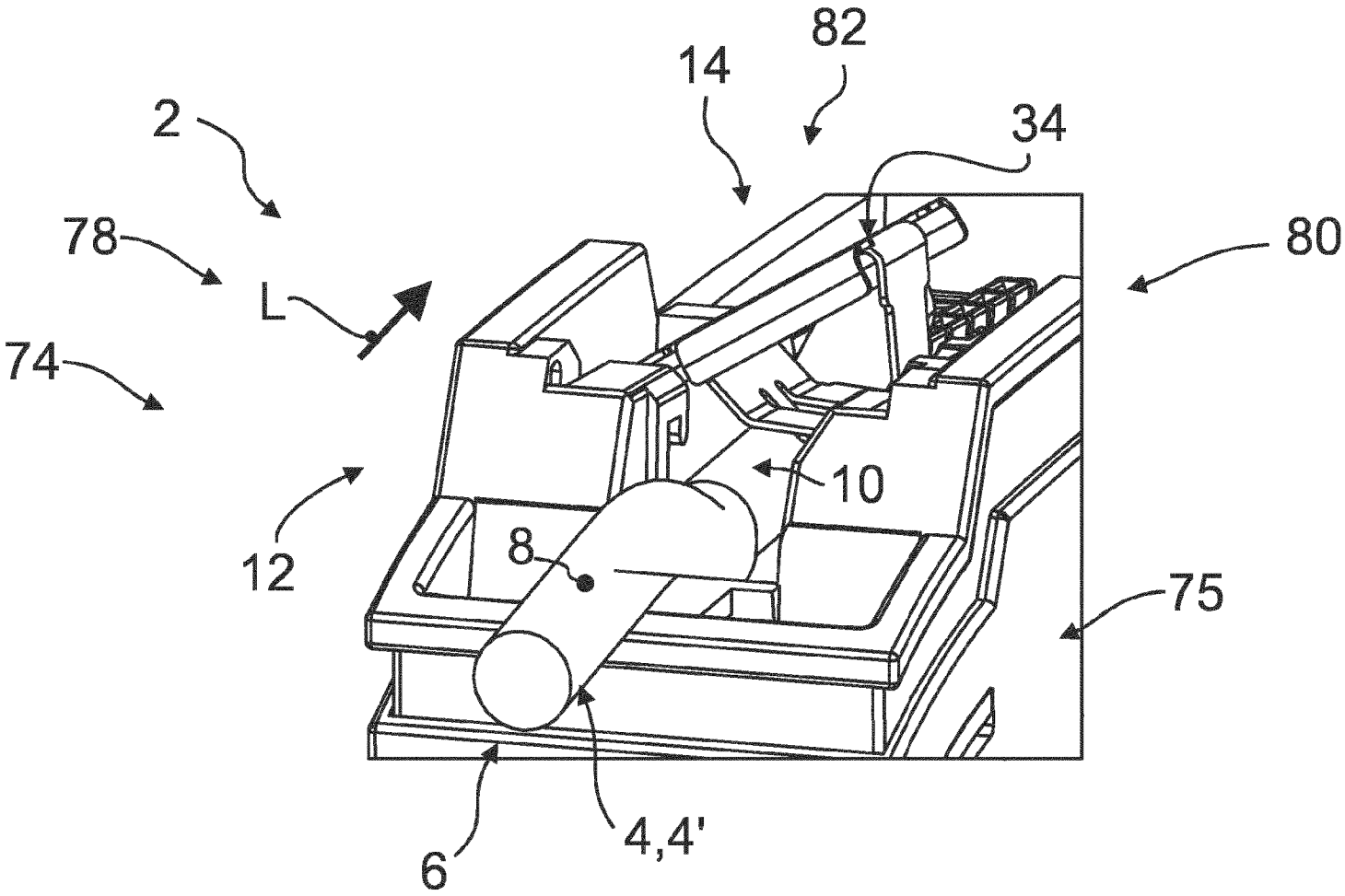

FIG. 13 shows the connecting device 2 of FIG. 1 with a cable 6 arranged thereon in the same illustration as in FIG. 12, but in a perspective view which on the housing head 84 in an arrangement on the electronics housing 74, wherein the cover 34 is in an open position. In this exemplary embodiment, the connecting device 2 is arranged on an outside 82 of the electronics housing 74 or its housing body 75.

Figure 14:
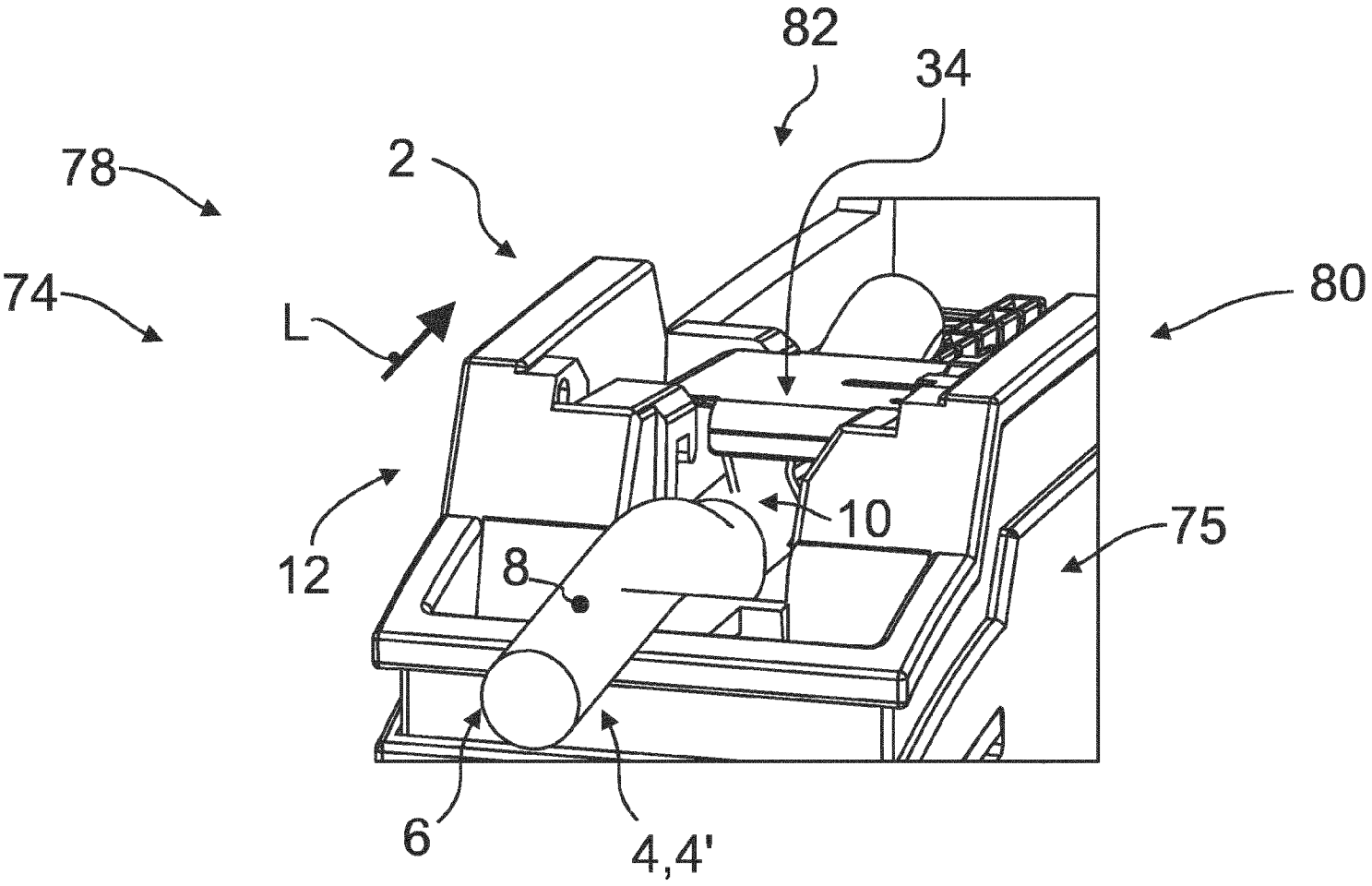

FIG. 14 illustrates the connecting device of FIG. 1 in the same illustration as in FIG. 13, wherein the cover 34 is in a closed position and in this case contacts the uninsulated conductor section 10 arranged in the receiving space 14.

Figure 15:
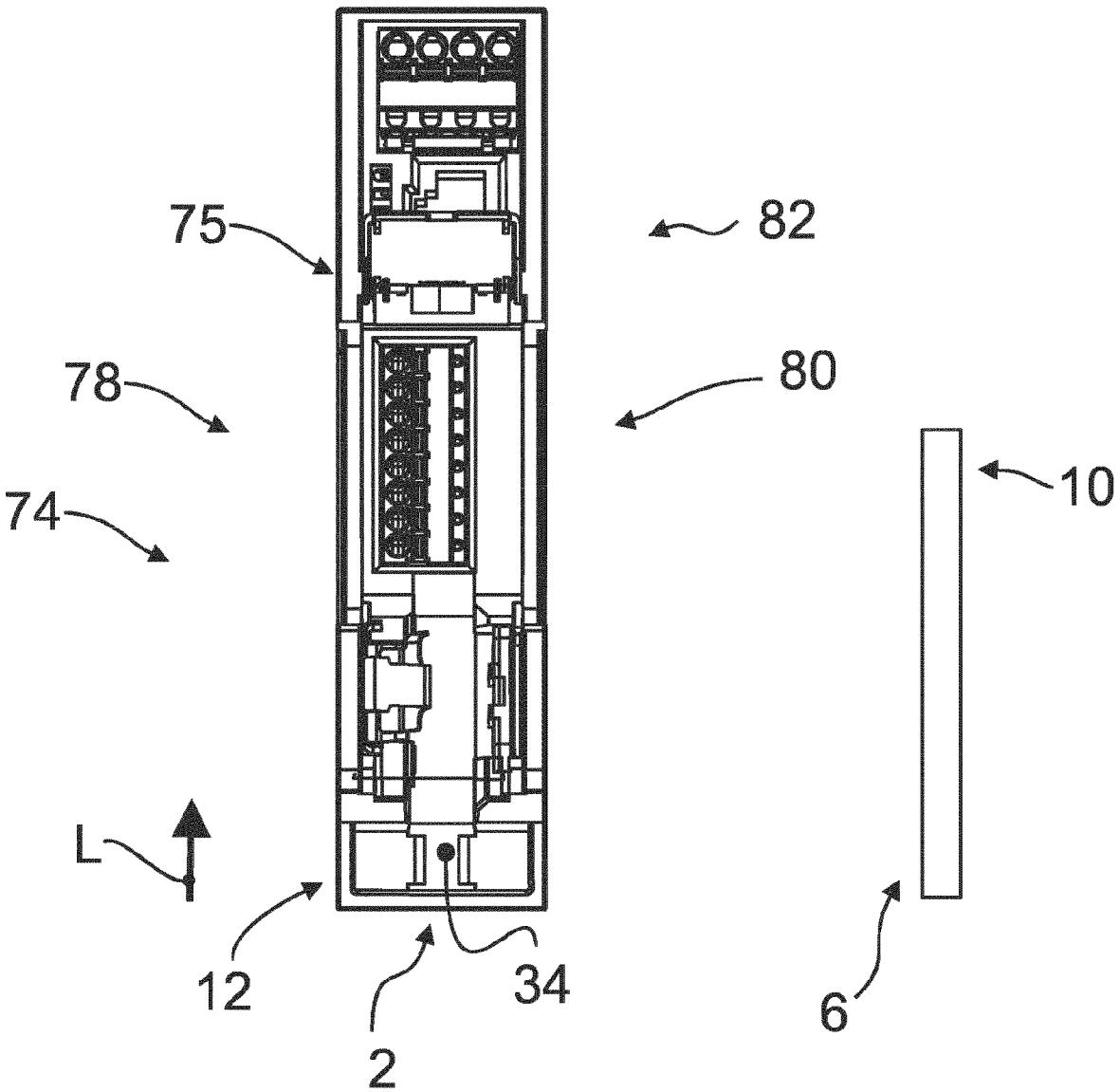

FIG. 15 shows the exemplary embodiment of an electronics housing according to the invention in the same illustration as in FIG. 12, but in a view indicated by E in FIG. 12, wherein the cover 34 is in an open position, in order to be able to arrange the conductor 4 on the connecting device 2 for the electrical contacting thereof.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE SIGNS

Connecting device 2
Conductor 4
Shield conductor 4'
Cable 6
Sheath layer 8
Uninsulated conductor section 10
Receiving body 12
Receiving space 14
Opening 16
First leg 18
First side inner wall 20
Second leg 22
Second side inner wall 24
Web 26
Bottom 28
Free end of the first leg 30
Free end of the second leg 32
Cover 34
Spring element 36
Printed circuit board
Contact section of the printed circuit board 37'
Spring leg 38
End of the spring leg 40
Free end of the spring leg 42
Connecting section 44
Rear side of the cover 46
Through-hole 48
Projection 50
Contact tongue 52
Pivot axis 54

Free end of the conductor 56
Conductor axis 58
Latching means 60
Latching hook 62
Free end of the latching hook 64
Further free end of the latching hook 66
Top of the cover 68
Surface normal 70
Abutment side of the spring leg 72
Electronics housing 74
Housing body 75
Housing base 76
Outside of the electronics housing 78
Housing head 80
Outside of the electronics housing 82
Angle W
Longitudinal extent of the receiving space L

The invention claimed is:

1. An electronics housing, comprising:

a housing body; and a printed circuit board, wherein the housing body has a connecting device for connecting a conductor, comprising a shield conductor, of a cable to the printed circuit board, wherein the connecting device has a receiving body in which a receiving space with an opening for the conductor is formed, wherein a cover for the opening is provided and is movable between an open position, in which the cover opens the opening for inserting an uninsulated conductor section of the conductor into the receiving space, and a closed position, in which the cover closes the opening at least in sections, wherein the receiving body of the connecting device is configured such that the printed circuit board is arrangeable with at least one contact section in the receiving space, and, in a closed position, the cover presses, the uninsulated conductor section inserted into the receiving space for the electrical contacting thereof against the contact section of the printed circuit board arranged in the receiving space, wherein at least one spring element is arranged on the cover and is configured such that when the cover is in the closed position, the cover projects into the receiving space at least in sections and presses by applying a spring force at least on the uninsulated conductor section inserted into the receiving space for the electrical contacting thereof toward the contact section of the printed circuit board, and wherein the cover and/or the spring element is/are electrically conductive at least in sections and is/are configured so as to electrically contact the contact section of the printed circuit board at a side facing away from the uninsulated conductor section inserted into the receiving space.

2. The electronics housing according to claim 1, wherein the receiving body has a through-opening for the printed circuit board, which is slit-shaped and through which the printed circuit board is arrangeable with at least one contact section projecting into the receiving space.

3. The electronics housing according to claim 1, wherein a wall of the receiving body is formed at least in sections by a section of the printed circuit board comprising the contact section of the printed circuit board.

4. The electronics housing according to claim 1, wherein the printed circuit board is an integral component part of the housing body comprising a housing wall of the housing body.

5. The electronics housing according to claim 1, wherein the cover is arranged on the receiving body so as to pivot about a pivot axis between the open position and the closed position, and wherein the pivot axis is arranged in parallel to the uninsulated conductor section of the conductor received in the receiving space.

6. The electronics housing according to claim 5, wherein the spring element has at least one strip-shaped spring leg which is inclined in relation to the cover and at least a section of which is brought into abutment on the uninsulated conductor section of the conductor arranged in the receiving space when the cover is in the closed position.

7. The electronics housing according to claim 6, wherein the spring leg is arranged on the cover such that the spring leg is inclined toward or away from the pivot axis.

8. The electronics housing according to claim 6, wherein the spring leg is integrally formed with the cover.

9. The electronics housing according to claim 6, wherein the spring leg has one end that is held or formed on the cover and a free end which is resiliently deflectable in relation to the end which is held or formed on the cover.

10. The electronics housing according to claim 6, wherein the spring leg is arranged on a rear side of the cover which, in the closed state, faces the receiving space.

11. The electronics housing according to claim 6, wherein the spring element is connected to so as to be formed on the cover at a distance therefrom, by a connecting section.

12. The electronics housing according to claim 6, wherein the spring element has at least one projection which projects from the spring leg toward the receiving space when the cover is in the closed position.

13. The electronics housing according to claim 12, wherein the at least one projection comprises a contact tongue which extends from the spring leg toward the receiving space at an angle when the cover is in the closed position, and wherein the contact tongue extends from the spring leg at an obtuse angle.

14. The electronics housing according to claim 13, wherein the contact tongue is integrally formed on the spring leg.

15. The electronics housing according to claim 1, wherein at least the spring element, comprising the cover, comprises at least in sections of an electrically conductive material or comprises such an electrically conductive material.

16. The electronics housing according to claim 1, wherein the cover is integrally formed with a spring element arranged thereon by a stamped and bent part from a metal sheet.

17. The electronics housing according to claim 1, wherein a latching device is provided and is configured to latch, when the cover is in the closed position, so as to block a movement of the cover.

18. The electronics housing according to claim 1, wherein the receiving space is integrally formed on the housing body.

19. The electronics housing according to claim 1, wherein the receiving space is arranged on an outside of the electronics housing.

* * * * *